United States Patent [19]

Guard et al.

[11] 4,324,370

[45] Apr. 13, 1982

[54] POOL COVER ROLLER ASSEMBLY

[75] Inventors: Wayne Guard; Tibor Feher, both of Milton, Canada

[73] Assignee: Feherguard Products, Milton, Canada

[21] Appl. No.: 204,408

[22] Filed: Nov. 6, 1980

[51] Int. Cl.[3] ..... B65H 17/46

[52] U.S. Cl. ..... 242/86.52; 4/502

[58] Field of Search ..... 242/85, 86.52, 67.1 R, 242/68; 4/498, 499, 500, 501, 502, 503, 504, 505

[56] References Cited

U.S. PATENT DOCUMENTS

| | | | |
|---|---|---|---|
| 987,593 | 3/1911 | O'Maley | 242/86.52 |
| 2,808,845 | 10/1957 | Wood | 4/500 |
| 3,374,964 | 3/1968 | Carvotta | 242/86.52 |
| 3,747,132 | 7/1973 | Foster | 4/502 |
| 4,001,900 | 1/1977 | Lamb | 4/498 |
| 4,101,987 | 7/1978 | Gagnon | 4/504 |

*Primary Examiner*—Edward J. McCarthy
*Attorney, Agent, or Firm*—Rogers, Bereskin & Parr

[57] ABSTRACT

A roller apparatus for winding and unwinding a pool cover is provided which comprises a telescoping roller section which can be adjusted in length, wheel or pedestal supports to support the roller above a pool edge, axle members connecting the roller to the wheel or pedestal supports, the latter containing ball bearings to permit axle rotation and means, such as a crank or motor, connected to one of the axle members for rotating the roller to collect the pool cover, the latter being connected to the roller. Once the pool cover is taken up, the apparatus can be rolled on its wheels, or carried where pedestal supports are used, to a storage area.

20 Claims, 8 Drawing Figures

64
48
38
37
32'
44
70
42
72
36
34
50
68
28
54
26
3
3
40
38
20
30
52
4
4
2
2
22
24

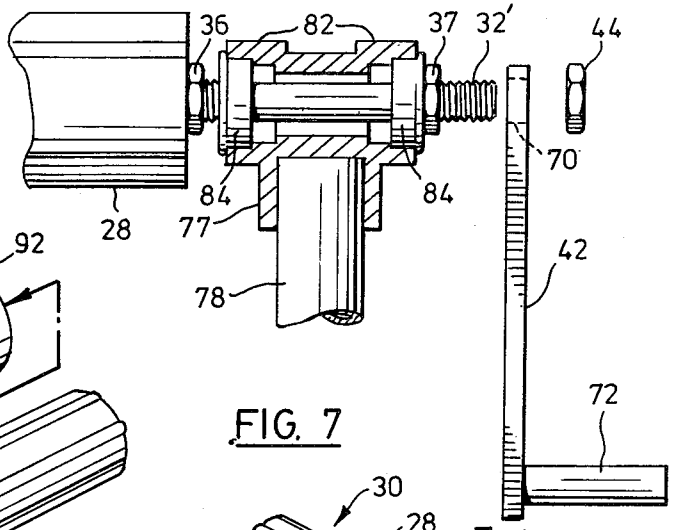
FIG. 7
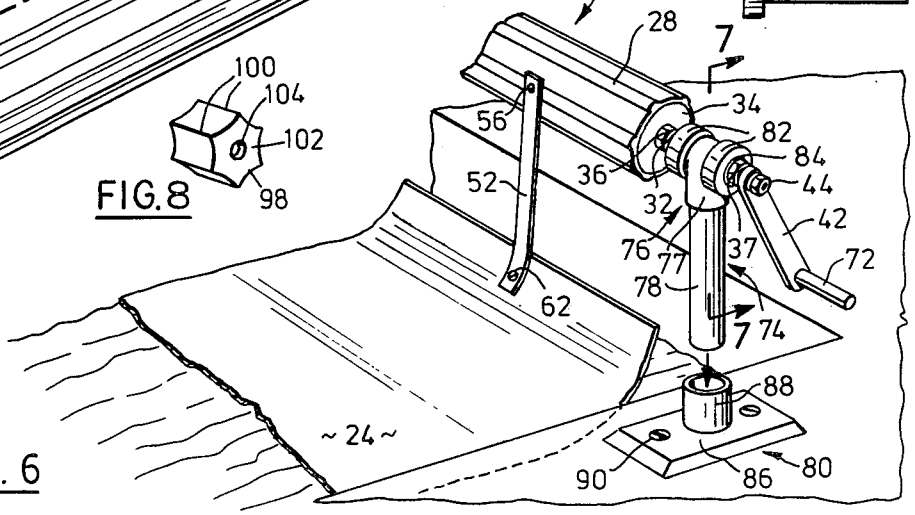
FIG. 6
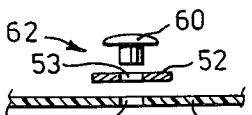
FIG. 4
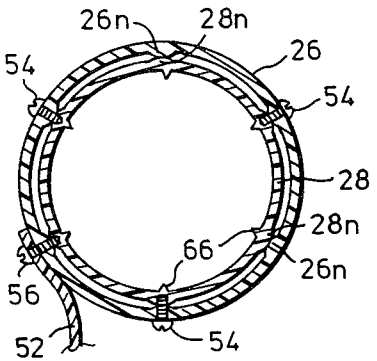
FIG. 3
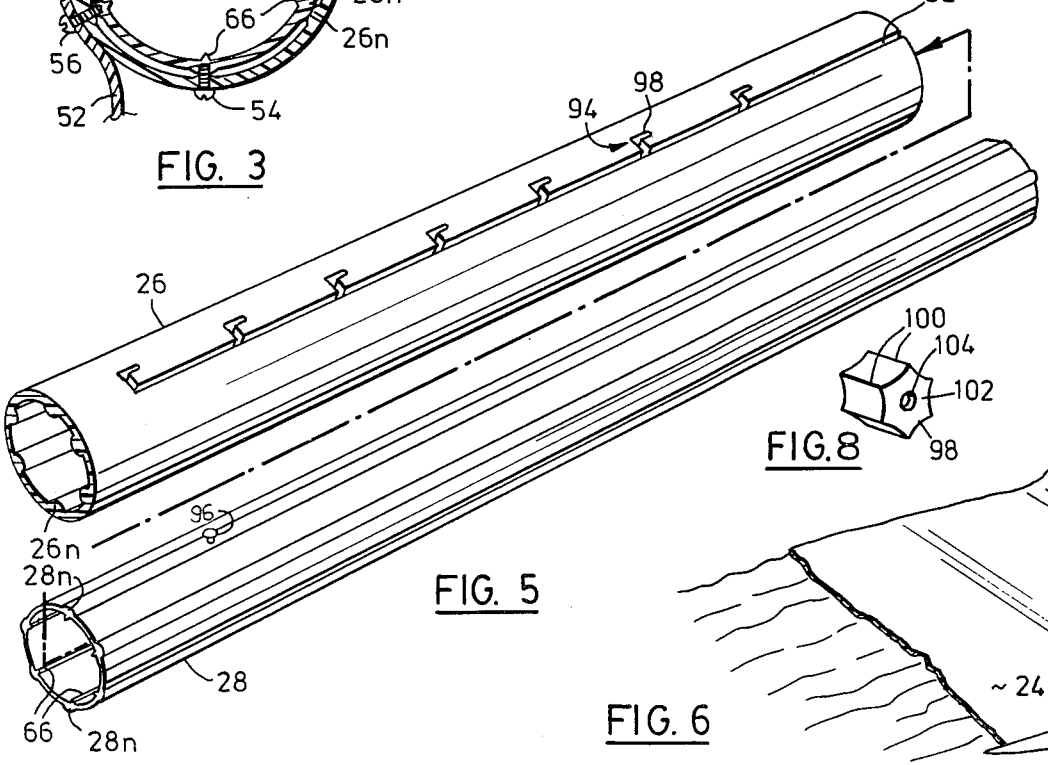
FIG. 5
FIG. 8

POOL COVER ROLLER ASSEMBLY

This invention relates to a device for use in removing, applying and storing a swimming pool cover.

In addition to being used in the non-swimming season to keep a pool free of debris and precipitation, pool covers are commonly placed over pools during swimming season in periods of non-use to minimize heat loss from the pool water, in some cases to transfer solar heat to the pool water while insulating against heat loss and to keep the water clean of debris. Such pool covers are commonly made from one or more of foam, plastic, vinyl and cloth and usually float on the water surface of the pool. Hereinafter such covers will be referred to collectively as summer covers.

Such summer covers best serve their purpose if they are put on the pool whenever the pool is not being used, for example, during the night. Accordingly, summer covers can be put on and taken off of pools many times during a swimming season. Pool covers conventionally comprise a single sheet of material sized for the pool in question and accordingly tend to be large, heavy and awkward to remove, to fold or roll up for temporary storage, and to move to a storage position and consequently usually require more than one person to do so. This difficulty of course increases when debris and rain water has collected on top of the cover. Both the cover removal and application operations normally require at least two persons and even then is a very cumbersome feat. Further, the difficulty of removing the cover renders it unlikely that the cover can be collected in a manner suitable for convenient and efficient storage and hence it is usually necessary to properly fold or roll the cover after removal. This operation subjects the cover to dirt, leaves, grass clippings etc. which end up in the pool when the cover is replaced. Often the cover is quickly compacted and left to clutter up a corner of the pool area or a shed. Then to reapply the cover, it is necessary to unfold or unravel it to a large extent in order that a number of persons can essentially drag is over the pool. This awkward and cumbersome task of manually removing and replacing the pool cover in many cases results in a pool cover not being consistently used and often subjects the cover to rough handling, such as scraping across a patio, deck or rough ground resulting in damage to the cover and premature wear or destruction of the cover.

The invention described below provides a convenient and effort saving means for removing from or applying to a pool a typical summer cover. The device provides a roller usually as long as the largest width dimension of the cover and to which one edge of the cover is attached. Each end of the roller is supported above the pool edge by a wheel or a pedestal, and an axle number connected to the roller and carried by the wheel or pedestal, and by simply rotating one of the axles using a crank and handle, the roller is rotated and the pool cover is pulled off the pool and gathered in a roll on a roller. The roller is secured in position during this roll-up step and once the cover has been completely taken up, wheel stops can be removed, or in the case of a pedestal design, the latter can be lifted out of a base mount, and the assembly and cover removed to a storage position if desired.

If wheels are used as part of the support means, the complete operation of removing the pool cover and rolling the device to a storage position removed from the pool can be accomplished in most cases by a single person including a school age child. Similarly the application of the cover can be done by one person as, once the device has been re-positioned at the pool edge, the cover can be drawn over the pool by leading one side of the cover up the pool, the roller unravelling the cover in a uniform fashion along its length, or by pulling, from the other end of the pool, a rope suitably attached to one or two points on the lead end of the cover. Where a pedestal is used as part of the support means instead of wheels the operation of the device is the same, except that the roller must now be carried to and from a storage location by two persons, one at each end of the roller. Accordingly the difficulty caused to such operation by the size of the cover and the weight of the cover and any water or other material on top of it is removed and the cover is collected in a uniform roll for easy storage and straight forward re-application with a minimum amount of effort.

Accordingly, an apparatus for removing and storing a pool cover is provided which can be rested in a fixed position adjacent a swimming pool and which comprises a telescoping roller member with first and second ends that can be telescopically separated, support means for mounting the roller for rotational movement above the pool edge, means for securing one edge of the pool cover to the roller, and means for rotating the roller.

In accordance with this invention a device has been provided which can be easily operated to remove a pool cover of considerable weight while at the same time uniformly collecting the cover in a roll. The cover can then be conveniently stored away from the pool if desired and when the roller is mounted on wheels this can be quickly and easily done by one person. In addition, the cover does not collect debris from around the pool during collection and storage and is not subjected to rough handling that might decrease its useful life.

These advantages and others will become apparent as the invention is described below with reference to the drawings in which:

FIG. 3 is a sectional view taken along line 3—3 of FIG. 2 illustrating the locking of telescoping sections and attachment of cover straps;

FIG. 4 is a sectional view taken along line 4—4 of FIG. 1 illustrating the attachment of a strap to a pool cover;

FIG. 5 is an exploded perspective view of one end of the roller illustrating alternative means of locking telescoping sections;

FIG. 6 is a partial perspective view of one end of the roller assembly as positioned adjacent a pool edge illustrating a pedestal means for supporting the roller.

FIG. 7 is a sectional view taken along line 7—7 of FIG. 6 illustrating pedestal housing; and, FIG. 8 is a perspective view of an alternative axle receiving roller plug.

Figures 1, 2:
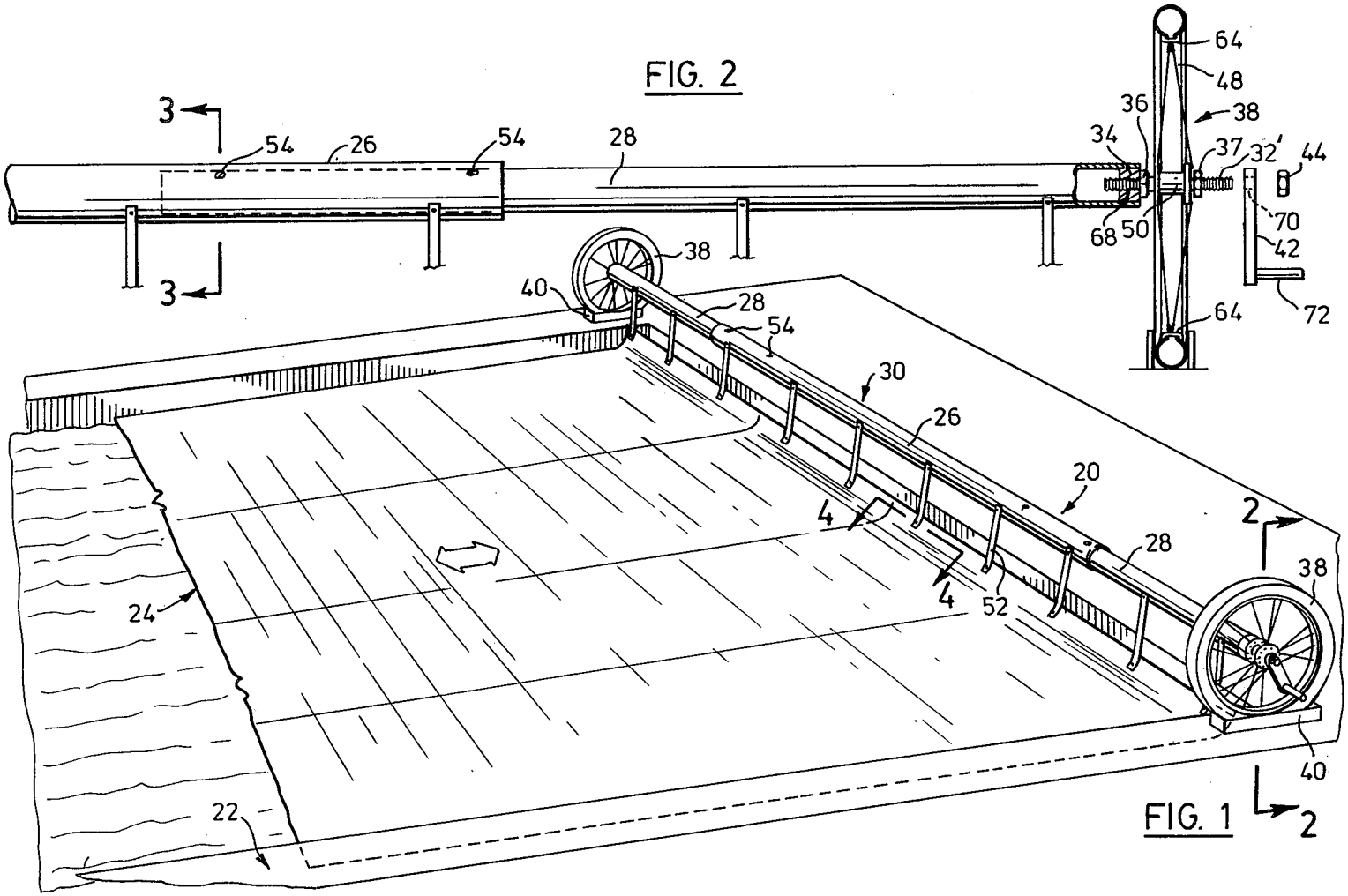
FIG. 1 is a diagrammatic perspective view of a pool with a cover roller assembly supported on wheels and the cover unreeled onto the pool water surface.
FIG. 2 is a view of one end of a preferred embodiment of the roller assembly illustrating the telescoping sections and partially sectioned along line 2—2 of FIG. 1 to illustrate wheel attachment, crank attachment, wheel construction and wheel block.

Reference is first made to FIG. 1 which shows a preferred embodiment 20 of the pool cover roller assembly located adjacent an end of a pool 22 and with a pool cover 24 unreeled onto the pool water surface. As can be seen from both FIGS. 1 and 2, the pool cover roller assembly 20 includes a central roller section 26 and end roller sections 28, 28, the latter being telescopically received within the central section 26 as will be discussed further below. Sections 26 and 28,28 in assembled form will be referred to generally herein as the roller 30. Roller 30 is connected at its ends (the free ends of sections 28) to axle members 32, 32, by means of roller plugs 34, 34 and lock nuts 36, 36. Wheels 38, 38 are maintained on axles 32, 32 adjacent lock nuts 36, 36 by lock nuts 37, 37 and maintained stationary on the pool edge by blocks 40, 40. The axle members 32, 32, wheels 38, 38 or their alternatives or equivalents and any hardware used to connect the axles to the roller and maintain the axles on the wheels, will be referred to generally herein as the support means. A crank or handle 42 is attached to axle member 32 adjacent one end of roller 30 by means of a lock nut 44. Wheel 38 includes a tire 46, spokes 48 and conventional hub 50 with ball bearing to permit axle member 32 to rotate freely in the hub 50. Lock nut 37 is only finger tight so as not to put pressure on the bearings. The pool cover 24 is connected to the roller 30 by means of straps 52 in a manner that will be explained below.

Roller 30 is adjusted to the length required by the width of the pool in question by telescoping end sections 28, 28 into or out of central section 26. At the chosen length, the sections are fixed relative one to the other in the manner shown in FIG. 3. As illustrated by FIG. 3, both central section 26 and end sections 28 includes a series of ribs **26*n* and 28*n* having a common uniform spacing and which in the case of central section 26 are disposed longitudinally from its inside diameter wall and in the case of end sections 28, 28 are disposed longitudinally from their outside diameter wall. As will be understood from an examination of FIG. 3, the inside and outside diameters, the wall thicknesses and the rib heights of each section 28 and 26, 26 are such that upon twisting an end section 28 within central section 26, ribs 26*n* and 28*n*, being similarly spaced, mesh with one of their counterparts when aligned radially, thereby locking the sections in a chosen position relative to each other. When ribs 26*n* and 28*n* are not in radial alignment, section 28 will slide freely within section 26 for positioning. The use of ribs 26*n* and 28*n* thereby allows for sections 26 and 28, 28 to be telescopically locked and unlocked while at the same time accommodating the tolerances encountered when extruding the tubular sections. To guard against ribs 26*n* and 28*n* disengaging from their locked radial alignment position during use, set screws 54 are inserted from the outside of section 26 so as to pass through both ribs 26*n* and 28*n*. Preferably screws are inserted at several such locations equally spaced about the circumference of section 26 and at several different points along the length of section 26 where it overlaps sections 28, 28 as illustrated in FIGS. 1 and 2. The roller sections 28, 26, 28** are preferably extruded of aluminum to minimize weight.

The pool cover 24 is attached to roller 30 by means of straps 52 which, as illustrated in FIG. 3, are secured to the roller with a set screw 56 which can be inserted to pass through a set of aligned ribs **26*n* and 28*n* for added strength both in holding the strap and locking sections 26 and 28. FIG. 4 illustrates strap attachment to the pool cover 24. Holes 23 and 53 are made in the cover 24 and strap 52 respectively to receive the neck of male portion 60 of a grommet 62. The neck of male 60 is fed through holes aligned in the strap 52 and cover 24 and forced into female portion 58 fastening grommet 62** together. Any suitable flexible material, such as nylon, can be used for the strapping and preferable material for the grommets is plastic or brass.

As illustrated in FIGS. 1 and 2, the roller 30 is supported above the pool edge by wheels 38, 38 and axle members 32, 32 which are connected to end roller sections 28, 28 as described below. Each wheel 38 includes a hub 50, spokes 48 radiating from the hub 50 to a rim 64 and a tire 46 disposed about the rim. The wheels 38 are of a conventional design, hub 50 having an axial opening lined with a ball bearing fitting.

Roller 30 is mounted between wheels 38, 38 by means of axle members 32, 32 which comprise a rod with threaded ends preferably made of steel to provide adequate strength. Each axle member 32 is attached to an end of roller 30 by means of a short cylindrical roller plug 34 inserted into each open end of end roller sections 28. The outside diameter of each roller plug 34 is slightly less than the inside diameter of each end section 28. In addition, disposed from the inside diameter wall of each end roller section 28, as shown in FIG. 3, are a series of uniformly spaced ridges 66. Roller plugs 34 are forced into the open ends of end sections 28 shearing off the tops of ridges 66 to provide a tight friction lock. Each roller plug 34 contains an axial opening 68 with an internal thread compatible with the external threads on axle members 32. Once roller plugs 34 are in place, an axle member 32 is threaded into each and secured there with a lock nut 36 which is tightened against roller plug 34. A wheel 38 is then positioned at each end of roller 30 by passing axle member 32 through the axial opening in each wheel hub 50. Each wheel 38 is secured on axle members 32 by lock nut 37 which is finger tightened only so as not to overtighten the wheel bearings in hub 50.

A crank 42 is threaded onto one of the axle members 32', the axle member passing through a threaded opening 70 at one end of the crank 42 and is secured against nut 37 by lock nut 44. In tightening lock nut 44, nut 37 is held with a wrench to prevent tightening the ball bearings in hub 50. Crank 42 is provided with a handle 72 at its end opposite opening 70 to assist in rotating the crank.

In use, the roller assembly 30, after assembly to the desired width as described, has the pool cover 24 attached to its roller 30 by means of the straps 52, and the cover 24 is reeled onto the roller 30 by rotating crank 42 which being threaded to axle member 32' and held by lock nuts 37 and 44 rotates that axle member which in turn, being secured to the roller 30 by means of roller plug 34 and lock nut 36, rotates the roller, both axle members 32 rotating freely on the ball bearing fittings in wheel hubs 50. During reeling, or unreeling, the roller assembly 30 is maintained stationary by placing the wheels 38 in wheel blocks 40, which as illustrated in FIG. 2 preferably comprise a four sided box without top or bottom. With the cover 24 reeled on the roller 30, the assembly can be easily rolled on its wheels 38 to a convenient place of storage. When it is desired to cover the pool, the assembly is simply rolled to pool edge, the wheels 38 placed in blocks 40 and the free end of the cover 24 pulled the length of the pool by one or both of its edges or by a pull rope attached centrally of the free end. To remove, the cover is simply rereeled using the crank 40 and the assembly rolled back to its storage position. A quick, easy, convenient means is thereby provided for repeatedly applying, removing and storing a summer pool cover during the swimming season.

FIG. 6 illustrates a pedestal that can be used in the support means as an alternative to the wheels 38 as a means of mounting the roller 30 in a stationary position above the pool edge. The pedestal 74 comprises a T-shaped ball bearing housing 76, neck 78 and a base 80. As illustrated, the ball bearing housing 76 includes ear portions 82 disposed at either side of the housing 76, and an axial opening running horizontally through the housing from ear to ear. Ball bearing fittings 84, 84 are contained in the ear portions 82 and line each end of the axial opening. The stem 77 of the housing 76 also contains an opening to receive the neck 74 and provide a friction fit between the neck and housing. In the case of preferred materials such as plastic the head and neck parts may be fused together. The neck 78 is then supported in an upright position by the base 80 which includes a plate 86 to which is attached a vertical sleeve 88 into which neck 78 is slideably received to provide a friction fit. The base plate 86 is secured to the shoulder of the pool with suitabe screws 90. The roller 30, roller plugs 34, axle member 32 and lock nut 36 are assembled as previously described, with the housing 76 of the pedestal 74 receiving an axle member 32 in the same manner as the hub 50 of wheel 38. Crank 42 is then secured to axle member 32' as previously described and the assembly operated in the same manner, axle member 32 now freely rotating on the ball bearing fittings within the pedestal head 76, in the same manner that it rotated within the wheel hub 50. After the pool cover 24 has been reeled up the pedestal housing and neck are lifted out of the pedestal base and carried to a storage position. The pedestal housing, neck and base are preferably constructed of plastic.

FIG. 5 illustrates a means, in addition to the meshing of ribs **26*n* and 28*n*, for securing central roller section 26 and end sections 28 at a chosen length. Sections 26 and 28 are constructed as described previously but with central section 26 further defining longitudinal slots 92,92 which extend a portion of the length of central section 26 from each end thereof. Disposed to one side of each slot 92 are a series of smaller L-shaped slots 94 positioned at distances selected to provide commonly used lengths for roller 30. End sections 28 are provided with a headed pin 96 disposed from its outer wall the throat of which travels along slot 92 and can be lodged in the base 98 of an L-shaped slot 94, for example by a friction fit, when ribs 26*n* and 28*n* are meshed in radial alignment. To do so, a headed pin 96 is disposed from the top of one of the longiutudinal ribs 28*n* on each end section 28 and the base portions 98 of L-shaped slots are in line with one of the ribs 26*n* on central section 26**.

FIG. 8 illustrates a second embodiment of an axle receiving insert as an alternative to roller plugs 34. Fluted plug 98 comprises a number of star tips 100 projecting radially from a short cylindrical-like body 102 which, as with roller plug 34, defines a threaded axial opening 104 for receiving axle member 32. When fluted plug 98 is used, the need for ridges 66 on the inner wall of roller sections 28 is eliminated, the plug 98 being forced into the open ends of end sections 28 with the star tips 100, depending on material use, either embedding in the inner wall of sections 28 or shearing off to provide a tight friction fit.

It will be appreciated from the foregoing that the invention can take various shapes and forms without departing from the essential spirit or scope of the invention. In addition to various support means, two of which have been described, alternative telescoping roller construction could be used. For example the roller sections 26 and 28 could be constructed without ribs **26*n* and 28*n* merely utilizing a male pin, female slot technique of the type illustrated in FIG. 5. It is only necessary that the sections be firmly fixed at a chosen length. Further, the roller 30 could comprise only two telescoping sections, that is, one section 28 and one section 26. Different means than that illustrated could be used to rotate the roller 30. A manually operated crank has been described. However the roller could very easily be motor driven. Axle members 32 could be threaded directly to the roller ends eliminating the transitional roller plugs 34. The pedestal housing 76 need not be T-shaped. It could be square. It need only house ball bearings in an axial opening to allow axle rotation and be mounted to a neck or leg 78. The wheels 38 may also be injection moulded plastic or fiberglass with bearings mounted in a central hub section. In addition, different hardware could be used. For example, instead of set screw 56 to fasten straps 52 to roller 30, a nylon pin comprising a head and a throat section having a bulge along its length could be used, the bulge being pushed through a hole in the roller to bear against the innermost wall of roller section 28 to keep the pin in position. Instead of grommets 62**, nylon bolts, nuts and washers could be used. It will also be appreciated that instead of mounting the roller assembly above the pool edge, it could conceivably be installed in a storage channel recessed below the pool edge at one end of the pool with the pool cover being fed out through an opening near the top of the pool side and the recess being hidden with a cover flush with and forming part of the shoulder or walkway adjacent the pool.

We claim:

1. An apparatus adapted to be rested on a surface adjacent to a pool for use in removing and storing a swimming pool cover and the like, comprising:

a telescoping roller member having a first tubular section and two second tubular sections, each section having inside and outside diameter walls, said second tubular sections adapted to be telescopically disposed one from each end of said first tubular section to provide first and second roller ends, said first tubular section further defining a plurality of uniformly spaced ribs disposed from its inner diameter wall and extending longitudinally of the section from end to end thereof, said second tubular sections further defining a plurality of similarly spaced ribs disposed from their outer diameter walls, and extending longitudinally of each section from end to end thereof, the said inner wall ribs of said first tubular section engaging upon the said outer wall ribs of said second member when the said ribs of each section are aligned radially, thereby fixing said sections relative to each other;

support means for mounting the first and second ends of the roller for rotational movement of the roller above the surface on which the apparatus is to be rested such that the pool cover can be wound onto the roller;

means for securing an edge portion of the pool cover to the roller; and, means for use in rotating said roller for winding up and unwinding said pool cover.

2. An apparatus as claimed in claim 1 wherein said support means comprises, at each of said first and second roller ends:

a longitudinal axle member connected to the roller end such that said axle member and said roller have a common axis, each axle member protruding from said roller end;

a wheel having a central hub defining an axial opening and a ball bearing housed about said opening, each wheel being positioned on an axle member by passing the protruding axle end through said hub opening;

means to secure said wheels on said axles and means to maintain said wheels rotationally stationary; and, wherein said rotating means is connected to one of said axle members.

3. An apparatus as claimed in claim 2 wherein said axle members have an external screw thread extending a portion of their length from both ends thereof and wherein said second tubular sections at said first and second roller ends define a series of uniformly spaced ridges projecting inwardly from their inner diameter walls, and wherein said support means further comprises:

cylindrical axle receiving plugs for placement one in each of said ridged ends, and having a diameter such that in placement a tip portion of the ridges are sheared off thereby providing a tight compression fit, and further defining a threaded axial opening for receiving one end of said threaded axle members; and, a pair of first lock nuts, whereby after placement of said plugs in said roller ends, said axle members are connected to said roller ends by being threaded into said plug opening and secured by means of a first lock nut tightened against said plug.

4. An apparatus as claimed in claim 3 wherein said means to secure each of said wheels on said axles comprises a second lock nut, each wheel being maintained on an axle intermediate said first and a second lock nut, and wherein the means to maintain each wheel rotationally stationary comprises a block having at least one side, two ends and a top open to receive said wheel.

5. An apparatus as claimed in claim 2 wherein said axle members have an external screw thread extending a portion of their length from both ends thereof and wherein said support means further comprises:

cylindrical axle receiving fluted plugs for placement one in each of said first and second roller ends, said fluted plugs defining a series of tips about its periphery which upon said placement cooperate with the inner diameter walls of said second tubular sections to lock said fluted plug to said second tubular sections, said fluted plugs further defining a threaded axial opening for receiving one end of said threaded axle members;

and, a pair of first lock nuts, whereby after placement of said plugs in said roller ends, said axle members are connected to said roller ends by being threaded into said plug opening and secured by means of a first lock nut tightened against said plug.

6. An apparatus as claimed in claim 5 wherein said means to secure each of said wheels on said axles comprises a second lock nut, each wheel being maintained on an axle intermediate said first and a second lock nut, and wherein the means to maintain each wheel rotationally stationary comprises a block having at least one side, two ends and a top open to receive said wheel.

7. An apparatus as claimed in claim 1 wherein said support means comprises, at each of said first and second roller ends:

a longitudinal axle member connected to the roller end such that said axle member and said roller have a common axis, each axle member protruding from said roller end;

a pedestal comprising a ball bearing housing having first and second ends and a bottom, and defining a circular hole extending from said first to said second end and an opening centrally located in said bottom, a base having a bottom plate and a sleeve vertically upstanding therefrom, a longitudinal neck adapted to be slideably received at its first end in said sleeve and at its second end in said housing opening and ball bearings positioned about said housing hole adjacent each end of said housing, each pedestal being positioned on an axle member by passing the protruding axle end through said housing hole;

means to secure said pedestals on said axle; and, wherein said rotating means is connected to one of said axle members.

8. An apparatus as claimed in claim 7 wherein said ball bearing housing is T-shaped having a horizontal top section defining said first and second ends and containing said circular hole and said ball bearings, and a vertical sleeve section centrally and downwardly disposed from said top section and adapted to receive said second end of said pedestal neck.

9. An apparatus as claimed in claim 8 wherein said axle members have an external screw thread extending a portion of their length from both ends thereof and wherein said second tubular sections at said first and second roller ends define a series of uniformly spaced ridges projecting inwardly from their inner diameter walls, and wherein said support means further comprises:

cylindrical plugs for placement one in each of said ridged ends, and having a diameter such that in placement a portion of the ridges are sheared off thereby providing a tight compression fit, and further defining a threaded axial opening for receiving one end of said threaded axle members;

and, a pair of first lock nuts, whereby after placement of said plugs in said roller ends, said axle members are connected to said roller ends by being threaded into said plug opening and secured by means of a first lock nut tightened against said plug.

10. An apparatus as claimed in claim 9 wherein said means to secure each of said pedestals on said axles comprises a second lock nut, each pedestal being maintained on an axle with its housing intermediate said first and a second lock nut.

11. An apparatus as claimed in claim 8 wherein said axle members have an external screw thread extending a portion of their length from both ends thereof and wherein said support means further comprises:

cylindrical axle receiving fluted plugs for placement one in each of said first and second roller ends, said fluted plugs defining a series of tips about its periphery which upon said placement cooperate with the inner diameter walls of said second tubular sections to lock said fluted plug to said second tubular sections, said fluted plugs further defining a threaded axial opening for receiving one end of said threaded axle members;

and, a pair of first lock nuts, whereby after placement of said plugs in said roller ends, said axle members are connected to said roller ends by being threaded into said plug opening and secured by means of a first lock nut tightened against said plug.

12. An apparatus as claimed in claim 11 wherein said means to secure each of said pedestals on said axles comprises a second lock nut, each pedestal being maintained on an axle with its housing intermediate said first and a second lock nut.

13. An apparatus as claimed in claims 2, 6 or 12 wherein said rotating means comprises a crank having first and second ends, said first end defining a threaded hole for receiving a threaded axle end, said second end having a handle disposed laterally thereto and in a direction generally parallel to the axis of said crank hole, and a third lock nut, whereby said crank is threaded onto one of said axles and secured tightly between the second lock nut and said third lock nut, in which position said handle extends in a direction away from said support means.

14. An apparatus as claimed in claims 2, 6 or 12 in which said means for securing an edge section of the pool cover to said roller comprises:

a plurality of flexible straps having first and second ends;

a plurality of screws; and, a plurality of grommets, whereby said straps are attached at their first ends to said cover edge section at uniform intervals using said grommets and are attached at their second ends to said roller using said screws.

15. An apparatus as claimed in claims 2 or 9 further comprising a plurality of screws, whereby said tubular sections are further secured at a predetermined position relative to each other by means of said screws inserted at intervals about and along portions of said roller where said first and second tubular sections overlap so as to pass through their aligned ribs.

16. An apparatus as claimed in claims 3 or 11 wherein said tubular sections and plugs are composed of aluminum.

17. An apparatus as claimed in claims 5 or 13 wherein said tubular sections and said plugs are composed of aluminum.

18. An apparatus as claimed in claims 7 or 8 wherein said pedestal is composed of plastic.

19. An apparatus as claimed in claim 2 wherein said wheels are composed of one member of the group of moulded plastic and moulded fiberglass.

20. An apparatus adapted to be rested on a surface adjacent to a pool for use in removing and storing a swimming pool cover and the like, comprising:

a telescoping roller member having first and second ends which are telescopically separable to vary the distance between said roller ends, said roller having a first tubular section and at least one second tubular section, each section having inside and outside diameter walls, said second tubular section adapted to be telescopically disposed from an end of said first tubular section, said tubular sections when so telescoped providing said first and second roller ends, said first tubular section further defining a plurality of uniformly spaced ribs disposed from its inner diameter wall and extending longitudinally of the section from end to end thereof, said second tubular section further defining a plurality of similarly spaced ribs disposed from its outer diameter wall, and extending longitudinally of the section from end to end thereof, the said ribs of said first tubular section engaging upon the said ribs of said second tubular section when the said ribs of each section are aligned radially, thereby fixing said tubular sections relative to each other;

support means for mounting the first and second ends of the roller for rotational movement of the roller above the surface on which the apparatus is to be rested such that the pool cover can be wound onto the roller;

means for securing an edge portion of the pool cover to the roller; and, means for use in rotating said roller for winding up and unwinding said pool cover.

* * * * *